US008622172B2

(12) United States Patent
Murphy

(10) Patent No.: US 8,622,172 B2
(45) Date of Patent: Jan. 7, 2014

(54) WINDOW JACK SCAFFOLD AND METHOD OF OPERATION THEREOF

(76) Inventor: Richard P. Murphy, Adamstown, MD (US)

( * ) Notice: Subject to any disclaimer, the term of this patent is extended or adjusted under 35 U.S.C. 154(b) by 0 days.

(21) Appl. No.: 13/608,094

(22) Filed: Sep. 10, 2012

(65) Prior Publication Data

US 2013/0248286 A1 Sep. 26, 2013

Related U.S. Application Data

(60) Provisional application No. 61/613,589, filed on Mar. 21, 2012.

(51) Int. Cl.
*E04G 3/00* (2006.01)

(52) U.S. Cl.
USPC ..... 182/53

(58) Field of Classification Search
USPC ..... 182/57, 58, 59, 60, 61, 53
See application file for complete search history.

(56) References Cited

U.S. PATENT DOCUMENTS

| | | | | | |
|---|---|---|---|---|---|
| 669,006 | A * | 2/1901 | Crawford | 182/58 |
| 863,877 | A * | 8/1907 | Regondi | 182/59 |
| 1,285,436 | A * | 11/1918 | Smith | 182/57 |
| 2,491,621 | A * | 12/1949 | Roos | 182/58 |
| 3,679,026 | A * | 7/1972 | Hansen et al. | 182/132 |
| 4,439,963 | A | 4/1984 | Feiss | |
| 5,203,426 | A * | 4/1993 | Sydnor | 182/57 |
| D350,614 | S | 9/1994 | Poole | |
| D357,326 | S | 4/1995 | Poole | |
| 5,465,540 | A | 11/1995 | Biernazki | |
| 5,605,023 | A | 2/1997 | Biernazki | |
| 6,983,824 | B1 * | 1/2006 | Dandurand | 182/82 |

* cited by examiner

*Primary Examiner* — James O Hansen
*Assistant Examiner* — Kristine Florio

(57) ABSTRACT

A method and apparatus for providing access to the exterior of a building in proximity to an opening, such as a window or door opening, in a wall of the building. Access is provided by a platform that is supported by brackets from vertical members fastened to the interior of the building. The platform may be passed from the interior of a building to the exterior of the building through an opening in the building. The apparatus may be assembled in, and installed from, the interior of a building.

52 Claims, 6 Drawing Sheets

— PRIOR ART —

WINDOW JACK SCAFFOLD AND METHOD OF OPERATION THEREOF

PRIORITY CLAIM

This Application claims priority from provisional application Ser. No. 61/613,589, titled "Window Jack Assembly for Interior Mounting", filed Mar. 21, 2012, which is hereby incorporated herein by reference in its entirety.

BACKGROUND

A window jack scaffold is a scaffold or jack, the platform of which is supported by a bracket and extends from a window opening in a wall of a building. An example of a prior window jack 100 is shown in FIG. 1. The window jack 100 extends from an opening in a wall 102 and comprises a platform 104 and a safety rail 106. In use, a transverse bar 108 is supported by the interior of the wall and by an external bracket 110. The exterior bracket 110 pushes against the exterior of the wall, below the platform 104, and the platform 104 rests on the sill of the window. Since the platform rests on the window sill, the window jack cannot be used for window installation. If the bracket rests against the exterior of the wall, the window jack cannot be used in applications where the region below the window is recessed. In both cases, the bulk of the window jack 100 is exterior to the building, so the window jack must be installed from the exterior of the building.

It would be useful, therefore, to provide a window jack that may be used in a variety of applications, including window installation, and may be installed from within the interior of a building.

BRIEF DESCRIPTION OF THE FIGURES

Exemplary embodiments of the present disclosure will be described below with reference to the included drawings such that like reference numerals refer to like elements and in which.

Figure 1:
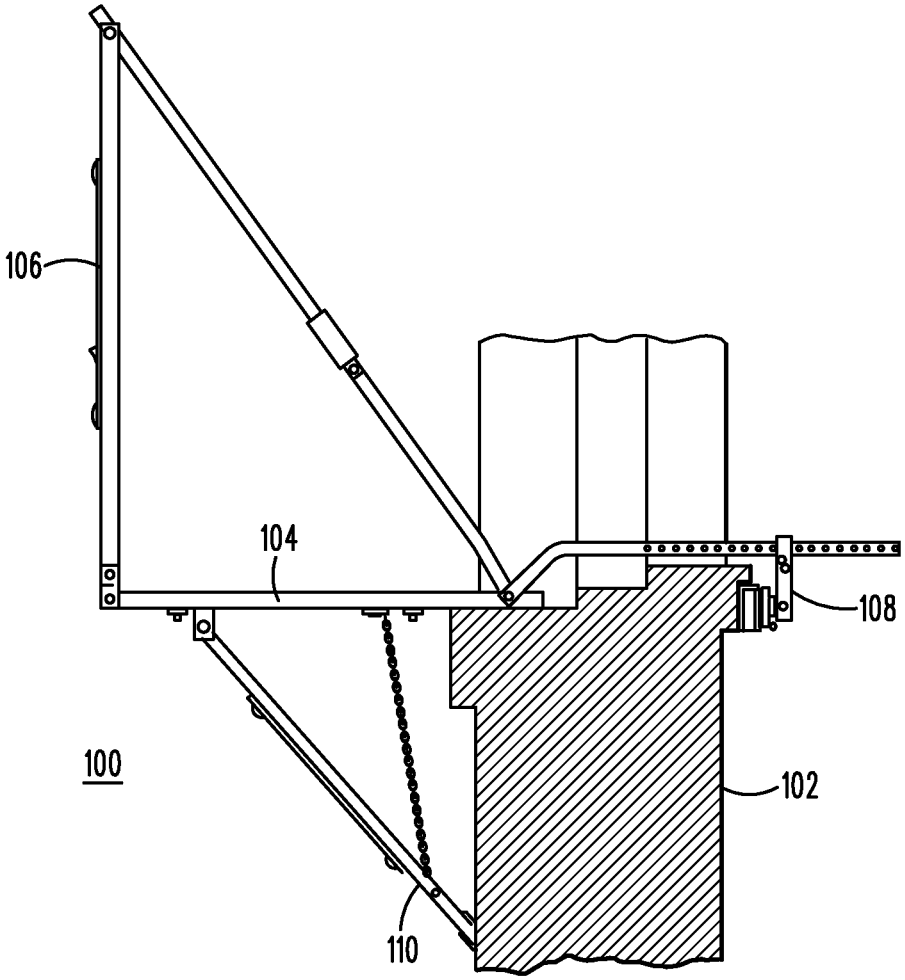
FIG. 1 is an example of a window jack or scaffold.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION

Before describing in detail embodiments that are in accordance with the present invention, it should be observed that the embodiments reside primarily in combinations of method and apparatus components related to providing access to the exterior of a building in proximity to an opening. Accordingly, the apparatus and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises, . . . a" does not, without more constraints, preclude the existence of additional identical elements in the process, method, article, or apparatus that comprises the element.

One aspect of the disclosure relates to a window jack scaffold that may be installed from the interior of a building. The window jack scaffold may be used to gain access to the exterior of the building in proximity to an aperture, such as window or door opening. Hereafter the term 'window' should be interpreted as any aperture in a wall of building.

Figure 2:
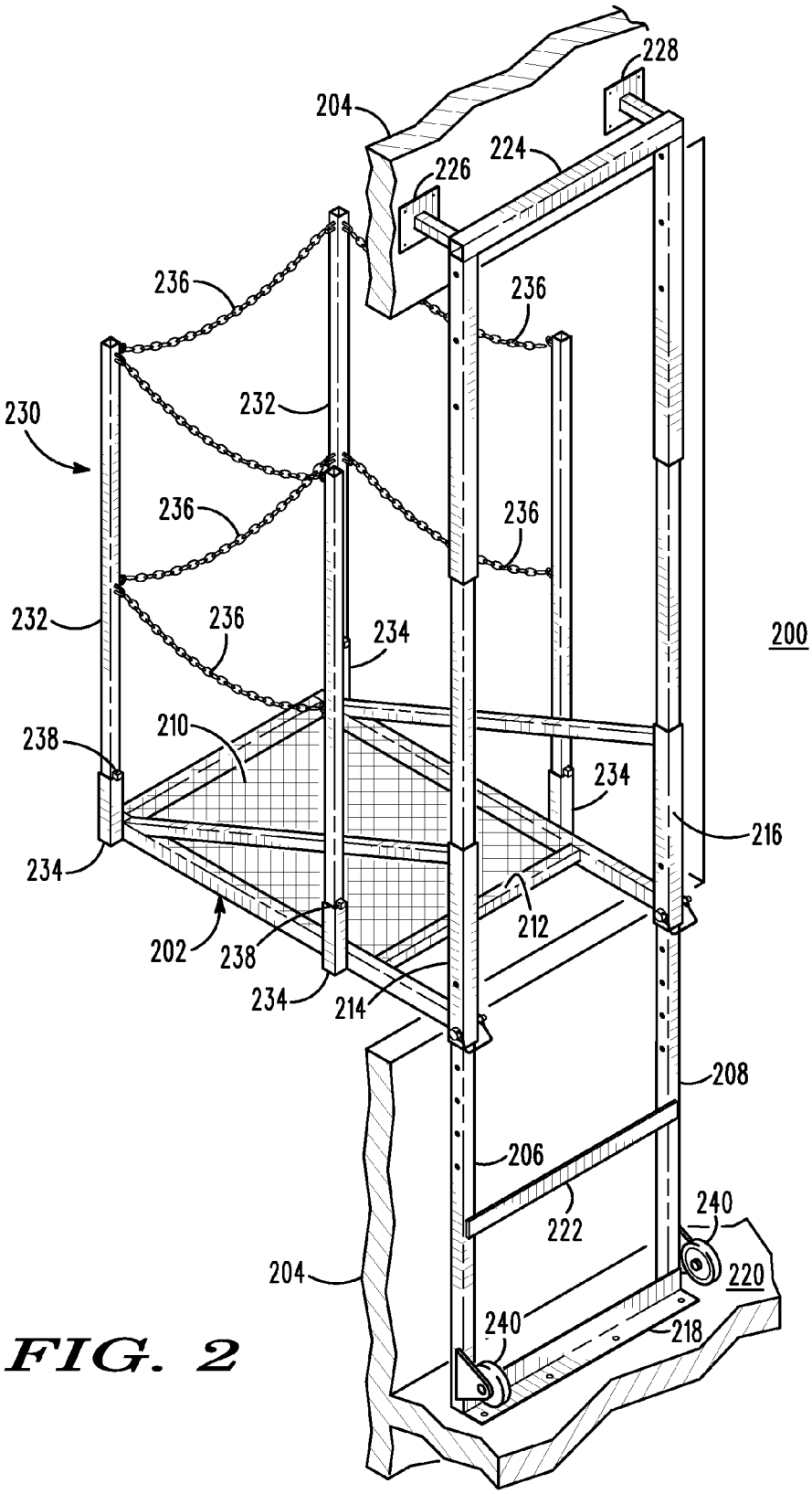
FIG. 2 is a diagram of a window jack scaffold in accordance with an embodiment of the invention.

FIG. 2 is a diagram of an apparatus in accordance with an exemplary embodiment of the disclosure. The apparatus 200 provides a scaffold, the platform 202 of which projects through a window or door opening in a wall 204 of a building. In one embodiment, the platform is constructed of 9 Gauge expanded metal attached to a frame and is approximately 3 feet long and 2 feet wide. Other sizes and other materials may be used without departing from the present disclosure. The apparatus 200 includes a first internal vertical member 206 and a second internal vertical member 208, positioned inside of the building, which support the platform 202. The internal vertical members may be constructed of various materials such as aluminum or steel. In one embodiment, the internal vertical members are approximately 7 feet in length and constructed of 1.25", 16 Gauge, hollow structural section (HSS) steel. Again, other sizes and other materials may be used without departing from the present disclosure. The platform 202 has an exterior working region 210 and a support region 212. The working region 210 of the platform may be passed from the interior of the building to the exterior of the building through an opening in the wall 204. The width of the platform 202 may be selected according to a standard window size.

A first bracket 214 is attached to the interior end of the platform 202 and is configured to removably couple the platform 202 to the first internal vertical member 206 at a first support location on the first internal vertical member 206, while a second bracket 216 is attached to the interior end of the platform 202 and is configured to removably couple the platform 202 to the second internal vertical member 208 at a second support location on the second internal vertical member 208.

A lower flange 218 is coupled to the first internal vertical member 206 below the first support location. The lower flange 218 is configured to enable the first internal vertical member 208 to be attached to an interior surface of the building, such as the floor or wall of the building.

In the exemplary embodiment shown, the lower flange 218 comprises a horizontal cross-member coupled to the first internal vertical member 206 below the first support location and also coupled to the second internal vertical member 208 below the second coupling location. One or more holes in the lower flange 218 enable the flange to be fastened to the interior floor 220 of the building, using screws or nails, for example. In one embodiment, the holes are spaced at approximately 3" intervals, but other spacing may be used.

A lower cross-member 222 may be provided to couple between the first (206) and second (208) internal vertical members below the first and second support locations. The lower cross-member 222 may be fixed. The length of the lower cross-member 222 is selected dependent upon the spacing between the brackets 214 and 216 of the platform 202.

In one embodiment, the lower cross-member 222, the lower flange 218 and the first and second internal vertical members (206 and 208) together form a lower support structure.

In an alternative embodiment, the internal vertical members 206 and 208 each have their own flange. The flanges may be configured to enable the internal vertical members to be attached to the floor 220.

The apparatus 200 may also include an upper support structure 224 that is adapted to removably couple between the first (206) and second (208) internal vertical members above the first and second support locations. In one embodiment, the upper support structure is pinned to the first and second internal vertical members, to allow it to be installed and removed. For example, the upper support structure 224 may be provided with a sleeve at each end. The sleeves may be passed over the internal vertical members and pinned in place using aligned holes in the sleeves and the internal vertical members.

A first upper flange 226 is coupled to the upper support structure 224 above the first support location. The first upper flange 226 is configured to enable the first internal vertical member 206 to be attached to the wall 204 in proximity to the opening.

A second upper flange 228 is coupled to the upper support structure 224 above the second support location. The second upper flange 228 is configured to enable the second internal vertical member 208 to be attached to the wall 204 in proximity to the opening.

In a further embodiment, the first (226) and second (228) upper flanges are directly coupled to the corresponding internal vertical members (206 and 208).

The apparatus 200 also includes a safety rail assembly 230 removably mounted to the exterior sides of the working region 210 of the platform 202. The safety rail assembly 230 has a number of posts 232 mountable in receptacles 234 on the exterior sides of the working region 210 of the platform 202. The posts are coupled to each other by low-stretch links 236. The links may be chains, cables, cords, rods or bars, for example. One embodiment uses 9 Gauge steel chain, for example.

In one embodiment, the posts 232 are inserted into the receptacles 234 until a stop 238 is reached. Once a stop is reached the post 232 is inserted to a depth sufficient to secure the post 232 in the receptacle 234.

In order to facilitate movement of the window jack within a building, the window jack may include wheels 240 attached to the vertical members 206 and 208, or attached to the lower flange 218. The wheels 240 may have single axles or may be castors. When the window jack is angled such the platform 202 is uppermost and the upper support 224 is held by a user, the lower end of the window jack is supported on the floor by the wheels 240. In order for the lower flange 218 to be raised from the floor, the wheels 240 extend from the vertical members. This enables the window jack to be wheeled to a new location with minimum effort. The wheels 240 are attached to the apparatus in proximity to the lower ends of the first and second internal vertical members, respectively, and are positioned such that the apparatus is supported by the first and second internal vertical members when the first and second internal members are oriented at, or close to, vertical and the apparatus is supported by the wheels when the first and second internal members are oriented at, or close to, horizontal.

Figure 3:
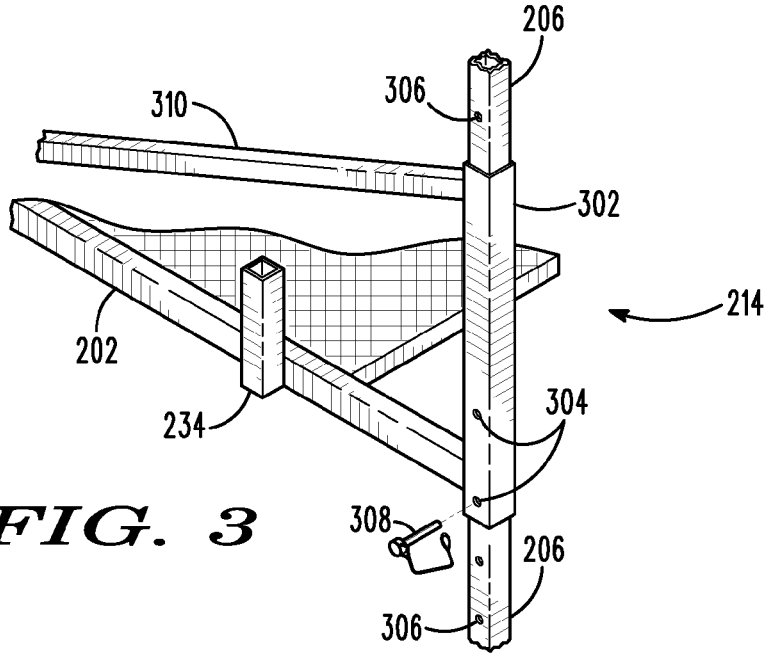
FIG. 3 is a diagram of a bracket for a window jack scaffold in accordance with an embodiment of the invention.

The platform 202 is supported on the first (206) and second (208) internal vertical members via brackets 214 and 216. An exemplary first bracket 214 is shown in more detail in FIG. 3. In the embodiment shown in FIG. 3, the bracket 214 has a sleeve 302 sized to slide over the first internal vertical member 206. The sleeve 302 has one or more holes 304 that align with one more holes 306 in the first internal vertical member 206 to enable the first bracket to be pinned to and supported by the first internal vertical member. A lock pin or other fastener 308 is passed through the aligned holes 304 and 306. The first bracket 214 may also include a diagonal support member 310 coupling between the top of the first sleeve 302 and a first side of the working region 210 of the platform 202. The second bracket (216 in FIG. 2) may have a corresponding structure.

Figure 4:
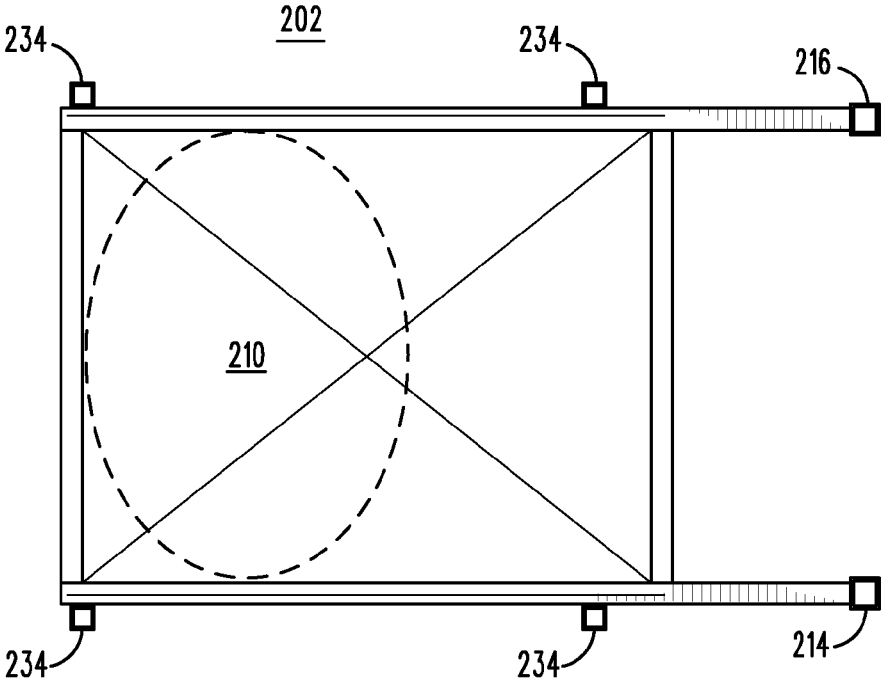
FIG. 4 is a top view of a platform of a window jack scaffold in accordance with an embodiment of the invention.

FIG. 4 is a top view of a platform 202. The working region of the platform is shown as the region 210. Receptacles 234 around the perimeter of the platform 202 provide support for corresponding safety rail posts. Once slid to a stop position, the safety rail posts are secured in the receptacles. Brackets 214 and 216 allow the platform to be removably coupled to and supported by internal vertical members within the building, and may include sleeves that slide over the internal vertical members before being secured at a desired position by pins or other fasteners.

Figure 5:
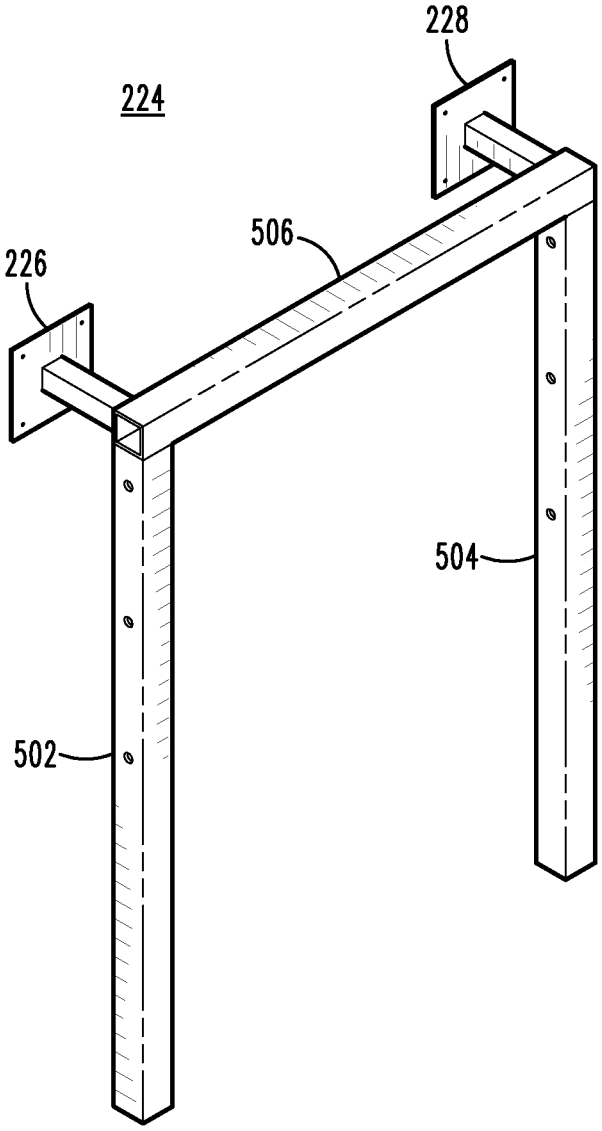
FIG. 5 is a diagram of an upper support structure of a window jack scaffold in accordance with an embodiment of the invention.

FIG. 5 is a view of an upper support structure 224. In this embodiment, the upper support structure 224 includes vertical sleeves 502 and 504 that may slide over the internal vertical members before being secured at a desired position by pins or other fasteners. The upper support structure 224 also includes cross brace 506. Flanges 226 and 228 allow the upper support structure 224 to be fastened to the interior surface of a wall using nails or screws, for example.

Figure 6:
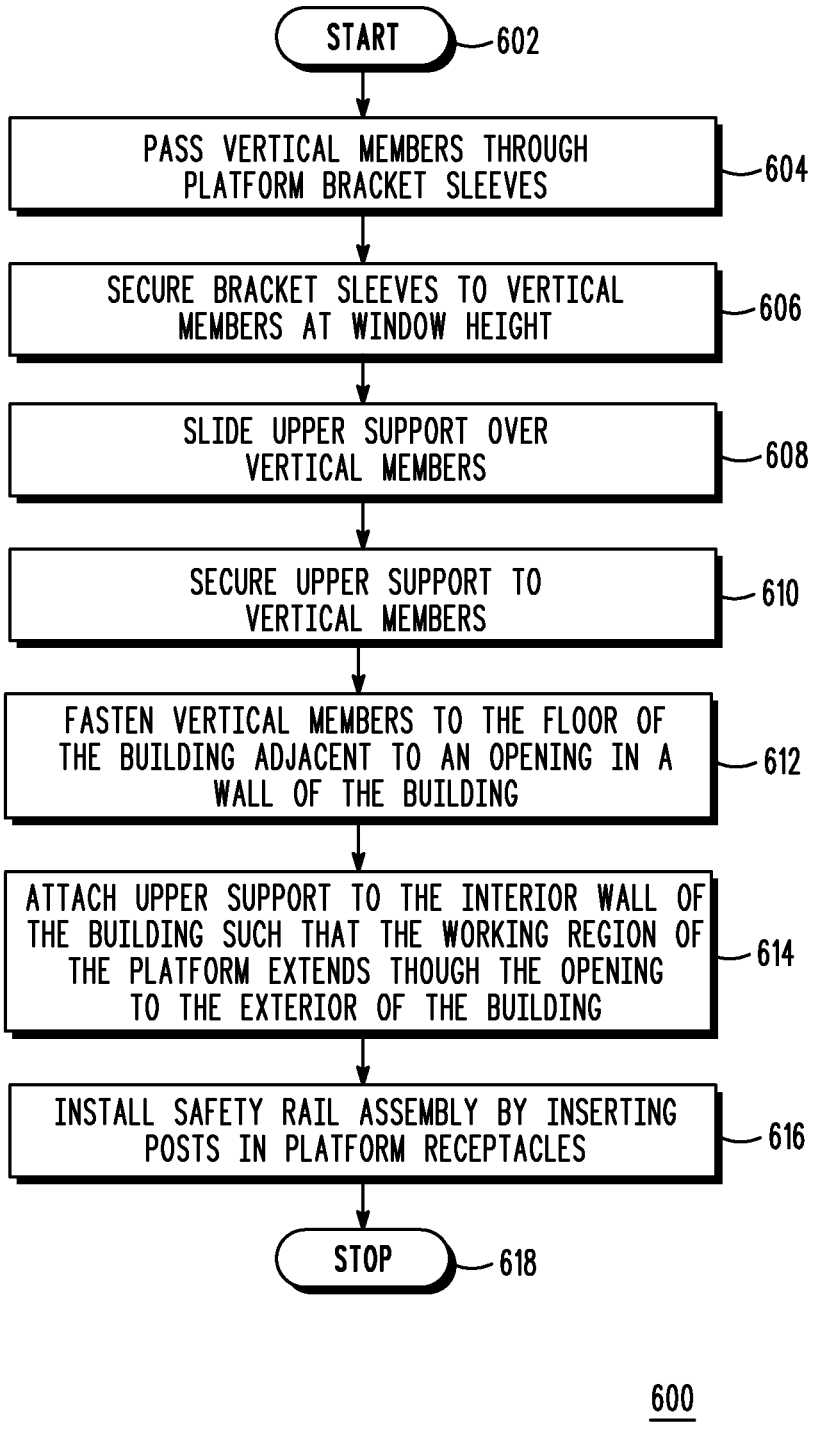
FIG. 6 is a flow chart of a method for installing window jack scaffold in accordance with an embodiment of the invention.

FIG. 6 is a flow chart 600 of a method for assembling a scaffold to enable access to the exterior of a building. Following start block 602, first and second internal vertical members are passed through first and second bracket sleeves, respectively, attached to a support end of a platform at block 604. Equivalently, the platform may be slid over the internal vertical members. At block 606 the first and second bracket sleeves are secured to the first and second internal vertical members, respectively. The sleeves may be secured using lock pins, for example. At block 608, an upper support structure is attached to couple between the first and second internal vertical members at a location above the first and second brackets. The upper support structure may include sleeves that slide over the first and second internal vertical members and may be pinned in place. The upper support structure is secured to the internal vertical members at block 610, using lock pins for example. At block 612, the bottoms of the first and second internal vertical members are fastened to a floor of the building adjacent to an opening in a wall of building. The internal vertical members may be fastened using nails or screws, for example. At block 614, the upper support structure is fastened to an interior surface of the wall at a position above the first and second brackets. The upper structure may be fastened using nails or screws passing through holes in flanges of the upper support structure attached to the internal vertical members. The internal vertical members are positioned such that a working region of the platform extends through the opening to the exterior of the wall and is supported by the internal vertical members. At block 616, a safety rail assembly is attached to the platform. The safety rail assembly comprises a number of posts linked by low-stretch links such as chains or cables. The safety rail assembly is installed by inserting the posts into receptacles at the edges of the platform. The platform is now ready for use and the method terminates at block 618. While the safety rails reduce any risk of a user falling from the platform, a fall prevention device may be used for added safety. The fall prevention device should be used when installing the safety rail assembly.

Figure 7:
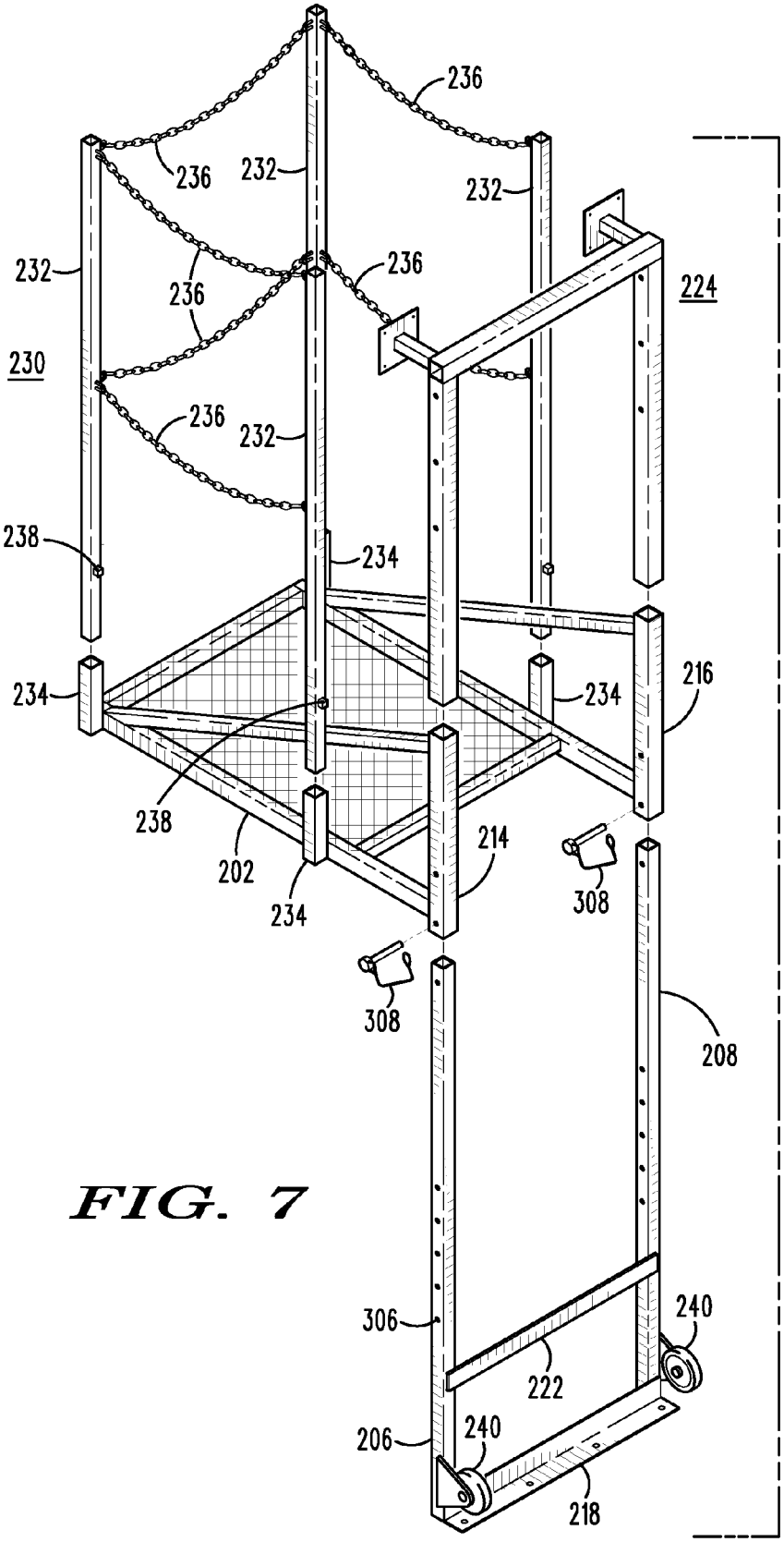
FIG. 7 is a diagram illustrating assembly of a window jack scaffold in accordance with an embodiment of the invention.

FIG. 7 is a diagram illustrating assembly of a window jack scaffold in accordance with an embodiment of the invention. Referring to FIG. 7, the sleeves of brackets 214 and 216 are slid over the internal vertical members 206 and 208, respectively and are pinned or otherwise fastened in place at the desired location. Lock pins 308 may pass through holes in the sleeves of brackets 214 and 216 that are aligned with corresponding holes 306 in the vertical members. The location may be selected dependent upon the height of a window sill, for example. Next, the upper support structure 224 is attached to the internal vertical members 206 and 208 by sliding the sleeves of the upper support structure over the internal vertical members. The upper support structure is then pinned or otherwise fastened in place. The safety rail assembly 230 is installed by inserting the posts 232 into corresponding receptacles 234 around the perimeter of the platform 202. The safety rail assembly includes the posts 232 and, low-stretch links, such as chains or cables that link between the safety rails posts, as shown in FIG. 2. The links may be coupled by clips or other fasteners or may be permanently attached.

Once assembled, the platform may be passed through an opening in a building and the internal vertical members 206 and 208 fastened to the interior wall and/or floor of the building. The internal vertical members may be fastened by nailing or screwing through flanges attached to the internal vertical members themselves or flanges attached to the upper support structure 224.

In this way, the apparatus 200 may be assembled inside a building and may be used, for example, to facilitate the installation of windows in a building.

Testing Procedure and Results for an example Window Jack:

An embodiment of a window jack system was constructed and tested. The window jack consisted of two main components: the vertical adjustable support posts and the projected platform with rails. For this system, ASTM A500, Grade B tube steel, A53 pipe, and A36 angles and plates were utilized throughout. The horizontal and vertical elements of the assembly were checked for level and the flanges or plates were fastened into place. The fasteners included four, 12d nails into the subfloor sheathing of the building and a single 12d nail into each of the top plates or flanges of the assembly. To test the window jack system, it was installed in two separate locations. First, the system was installed as it would be during practice in the field, i.e., projected out the window as shown in FIG. 2. This enables a downward force to be exerted on the working or standing region of the platform. An anchor point was installed in the concrete slab directly below the platform so that the vertical load could be properly applied. Second, the system was installed on an interior doorway, in the same fashion, so that loads could safely be applied in various directions to the rail above the platform. The window jack system was tested for the following four loading conditions by applying the load at varying locations and in variable directions on the system:

1. Platform vertical load
2. Platform horizontal load
3. Rail Post horizontal load
4. Rail Chain horizontal load The platform, when projected from the window, was subject to a maximum 685 pound load located 27" from the vertical system supports. Each of the horizontal tests was completed utilizing a 200 pound loading at the various locations. The tests on the safety rail were placed horizontal to a point that was 39" above the surface of the platform. The following sections describe the results of each of the loading conditions. The window jack may be constructed with various widths, such as with a 24" wide platform or an 18" wide platform.

Test #1—Platform Vertical Load

A vertical load was applied to the platform. With the apparatus utilized loading was applied in as small of increments as possible. Ultimately, 685 pounds of vertical load was applied to the platform. The maximum vertical deflection of the outside edge of the platform was 0.75 inches when this maximum loading was applied. The vertical members, inside the window, deflected 1.50" from vertical. The load was exerted for several minutes without any additional deflection. Both the horizontal platform and the vertical posts returned to their original position upon removal of the loading. It is estimated that about 3/16" of movement is due to the sleeve clearance that allows the platform height to be adjusted on the vertical posts. With a 200 pound vertical load, the deflection was measured to only be 0.25" based upon a section modulus from a 16 gauge steel tube thickness. With the same load on the platform support members, there was found to be less than half of the allowable design stress in bending and a quarter of the allowable design stress in shear. From this analysis, it was determined that the base frame can support the design stresses and transfer them to the supporting frame.

Test #2—Platform Horizontal Load

A horizontal load of 200 pounds was applied to the platform. This load was located on the outside edge of the platform. This loading resulted in the outside edge of the platform moving 4.5" out of square, corresponding to a rotation of approximately 6.8°. Once the load was removed the system returned to square.

Test #3—Rail Post Horizontal Load

A horizontal load of 200 pounds was applied to the chain anchor point on the corner post of the platform. This load was placed at the top of the post. This loading resulted in the top of the post deflecting 4" from vertical. The platform showed no measurable vertical or horizontal movement.

Test #4—Rail Chain Horizontal Load

A horizontal load of 200 pounds was applied to the center of the chain connected between the tops of the outer posts. This loading resulted in the top of the post deflecting 2" from vertical both towards the center and outward towards the load point. The platform showed no measurable vertical or horizontal movement.

The tested window jack system was found to meet or exceed the requirements listed in the Occupational Safety and Health Administration (OSHA) standards 1926.451 and 1926.502. The testing showed that the system was able to support a vertical load of as much as 685 pounds and horizontal loads of 200 pounds placed in several directions for a sustained period of several minutes.

Example Use

The window jack provides a temporary working platform which is totally assembled by one user from the inside of a building.

One example of the use the window jack for installation, removal and or maintenance of windows by a worker. When using or installing the window jack, the worker should wear a personal fall arrest (PFA) system at all times. To install a window, the worker should temporarily install the window and secure it with at least 4 nails or screws. Then the window jack may be installed from inside the building. Once the window jack is installed and properly secured, with a minimum of four 3" nails or screws at the bottom of the window jack and a minimum of two 3" nails or screws at the top, the worker should install the safety rail assembly on the exterior of the work platform from inside the building. The worker should not exit the building onto the platform until the safety rail is installed, and the worker should wear the proper PFA system 100% of the time.

Acceptable PFA connectors used for this application include Wire Clasp anchorage connectors, such as the Rose Model #10003209 for example. Wire Clasp anchorage connectors meet OSHA requirements, ANSI A10.14 Type 1, ANSI Z359.1 and CSA Z259.1 standards. The Wire Clasp anchorage connector is constructed of formed stainless steel, 6 mm diameter, polished finished and has a minimum breaking strength of 5,000 lb. ft. (22.2 KN). When used as part of PFA system, fall arresting forces must not exceed 1,800 lb. ft. (8 KN). A personal fall arrest system may be connected to a Wire Clasp Anchorage Connector by attaching a compatible self-closing, self-locking carabineer to a wire eye formed at the base of the Wire Clasp handle. The capacity of such a PFA is approximately 300 lbs. (140 kg) including weight of the user plus clothing, tools and other user-borne objects.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims as issued.

What is claimed is:

1. An apparatus comprising:

a first internal vertical member, configured for installation in the interior of a building;

a second internal vertical member, configured for installation in the interior of the building;

a platform having a working region that may be passed from the interior of a building to the exterior of the building through an opening in the building;

a first bracket attached to the platform and configured to removably couple the platform to the first internal vertical member at a first support location on the first internal vertical member, the first bracket comprising a first sleeve sized to slide over the first internal vertical member;

a second bracket attached to the platform and configured to removably couple the platform to the second internal vertical member at a second support location on the second internal vertical member, the second bracket comprising a second sleeve sized to slide over the second internal vertical member, and an upper support structure configured to couple the first and second internal vertical members above the first and second support locations, the upper support structure comprising first and second vertical sleeves joined by a cross brace, where the first vertical sleeve is sized to at least partially slide over the first internal vertical member above the first support location and the second vertical sleeve is sized to at least partially slide over the second internal vertical member above the second support location, where, in operation, the platform is cantilevered from the first and second internal vertical members via the first and second brackets, such that support for the platform is provided by the first and second internal vertical members, and wherein the upper support structure is configured to enable the first and second internal vertical members to be fastened to an interior surface of the building.

2. The apparatus of claim 1, further comprising:

a lower flange coupled to the first internal vertical member below the first support location, coupled to the second internal vertical member below the second support location, and configured to enable the first and second internal vertical members to be fastened to an interior surface of the building.

3. The apparatus of claim 2, where the lower flange is configured to enable the first and second internal vertical members to be fastened to an interior floor of the building.

4. The apparatus of claim 2, where the lower flange has one or more holes for a fastener.

5. The apparatus of claim 1, further comprising a lower cross member coupling between the first and second internal vertical members below the first and second support locations.

6. The apparatus of claim 1, where the upper support structure is removably coupled to the first and second internal vertical members.

7. The apparatus of claim 1, where the first vertical sleeve has one or more holes that align with one or more holes in the first internal vertical member to enable the first vertical sleeve to be pinned to the first internal vertical member; and the second vertical sleeve has one or more holes that align with one or more holes in the second internal vertical member to enable the second vertical sleeve to be pinned to the second internal vertical member.

8. The apparatus of claim 1, where the first bracket further comprises a first diagonal support member coupling between the first sleeve and a first side of the working region of the platform; and the second bracket further comprises a second diagonal support member coupling between the second sleeve and a second side of the working region of the platform.

9. The apparatus of claim 1, further comprising a safety rail removably mounted to the perimeter of the working region of the platform.

10. The apparatus of claim 9, where the safety rail comprises:

a plurality of posts mountable in receptacles on the perimeter of the working region of the platform; and a plurality of low-stretch links coupled between posts of the plurality of posts.

11. The apparatus of claim 10, where a low-stretch link of the plurality of low-stretch links comprises a chain.

12. The apparatus of claim 10, where a low-stretch link of the plurality of low-stretch links comprises a cable.

13. The apparatus of claim 1, where the first and second internal vertical members are approximately seven feet in length.

14. The apparatus of claim 1, further comprising:

first and second wheels attached to the apparatus in proximity to the lower ends of the first and second internal vertical members, respectively.

15. The apparatus of claim 14, where the apparatus is supported by the first and second internal vertical members when the first and second internal members are oriented at, or close to, vertical and the apparatus is supported by the first and second wheels when the first and second internal members are oriented at, or close to, horizontal.

16. The apparatus of claim 1, where the first and second vertical sleeves of the upper support structure are adjustably located on the first and second internal vertical members.

17. The apparatus of claim 1, where support of the platform is provided exclusively by the first and second internal vertical members via the first and second brackets.

18. An apparatus comprising:

a first internal vertical member, configured for installation in the interior of a building;

a second internal vertical member, configured for installation in the interior of the building;

a platform having a working region that may be passed from the interior of a building to the exterior of the building through an opening in the building;

a first bracket attached to the platform and configured to removably couple the platform to the first internal vertical member at a first support location on the first internal vertical member, the first bracket comprising a first sleeve sized to slide over the first internal vertical member;

a second bracket attached to the platform and configured to removably couple the platform to the second internal vertical member at a second support location on the second internal vertical member, the second bracket comprising a second sleeve sized to slide over the second internal vertical member, and an upper support structure configured to couple the first and second internal vertical members above the first and second support locations, the upper support structure comprising first and second vertical sleeves joined by a cross brace, where the first vertical sleeve is sized to at least partially slide over the first internal vertical member above the first support location and the second vertical sleeve is sized to at least partially slide over the second internal vertical member above the second support location, where, in operation, the platform is cantilevered from the first and second internal vertical members via the first and second brackets, such that support for the platform is provided by the first and second internal vertical members, the apparatus further comprising a first upper flange coupled to the upper support structure and the first internal vertical member above the first support location, the first upper flange configured to enable the first internal vertical member to be fastened to a wall of the building in proximity to the opening; and a second upper flange coupled to the upper support structure and the second internal vertical member above the second support location, the second upper flange configured to enable the second internal vertical member to be fastened to the wall of the building in proximity to the opening.

19. The apparatus of claim 18, where the wall is a vertical wall.

20. The apparatus of claim 18, further comprising:

a lower flange coupled to the first internal vertical member below the first support location, coupled to the second internal vertical member below the second support location, and configured to enable the first and second internal vertical members to be fastened to an interior surface of the building.

21. The apparatus of claim 20, where the lower flange is configured to enable the first and second internal vertical members to be fastened to an interior floor of the building.

22. The apparatus of claim 20, where the lower flange has one or more holes for a fastener.

23. The apparatus of claim 18, further comprising a lower cross member coupling between the first and second internal vertical members below the first and second support locations.

24. The apparatus of claim 18, where the upper support structure is removably coupled to the first and second internal vertical members.

25. The apparatus of claim 18, where the first vertical sleeve has one or more holes that align with one or more holes in the first internal vertical member to enable the first vertical sleeve to be pinned to the first internal vertical member; and the second vertical sleeve has one or more holes that align with one or more holes in the second internal vertical member to enable the second vertical sleeve to be pinned to the second internal vertical member.

26. The apparatus of claim 18, where the first bracket further comprises a first diagonal support member coupling between the first sleeve and a first side of the working region of the platform; and the second bracket further comprises a second diagonal support member coupling between the second sleeve and a second side of the working region of the platform.

27. The apparatus of claim 18, further comprising a safety rail removably mounted to the perimeter of the working region of the platform.

28. The apparatus of claim 27, where the safety rail comprises:

a plurality of posts mountable in receptacles on the perimeter of the working region of the platform; and a plurality of low-stretch links coupled between posts of the plurality of posts.

29. The apparatus of claim 28, where a low-stretch link of the plurality of low-stretch links comprises a chain.

30. The apparatus of claim 28, where a low-stretch link of the plurality of low-stretch links comprises a cable.

31. The apparatus of claim 18, where the first and second internal vertical members are approximately seven feet in length.

32. The apparatus of claim 18, further comprising:

first and second wheels attached to the apparatus in proximity to the lower ends of the first and second internal vertical members, respectively.

33. The apparatus of claim 32, where the apparatus is supported by the first and second internal vertical members when the first and second internal members are oriented at, or close to, vertical and the apparatus is supported by the first and second wheels when the first and second internal members are oriented at, or close to, horizontal.

34. The apparatus of claim 18, where the first and second vertical sleeves of the upper support structure are adjustably located on the first and second internal vertical members.

35. The apparatus of claim 18, where support of the platform is provided exclusively by the first and second internal vertical members via the first and second brackets.

36. An apparatus comprising:

a first internal vertical member, configured for installation in the interior of a building;

a second internal vertical member, configured for installation in the interior of the building;

a platform having a working region that may be passed from the interior of a building to the exterior of the building through an opening in the building;

a first bracket attached to the platform and configured to removably couple the platform to the first internal vertical member at a first support location on the first internal vertical member, the first bracket comprising a first sleeve sized to slide over the first internal vertical member;

a second bracket attached to the platform and configured to removably couple the platform to the second internal vertical member at a second support location on the second internal vertical member, the second bracket comprising a second sleeve sized to slide over the second internal vertical member, and an upper support structure configured to couple the first and second internal vertical members above the first and second support locations, the upper support structure comprising first and second vertical sleeves joined by a cross brace, where the first vertical sleeve is sized to at least partially slide over the first internal vertical member above the first support location and the second vertical sleeve is sized to at least partially slide over the second internal vertical member above the second support location, where, in operation, the platform is cantilevered from the first and second internal vertical members via the first and second brackets, such that support for the platform is provided by the first and second internal vertical members, and where the cross brace joins the first and second vertical sleeves of the upper support structure in a u-shape.

37. The apparatus of claim 36, further comprising:

a lower flange coupled to the first internal vertical member below the first support location, coupled to the second internal vertical member below the second support location, and configured to enable the first and second internal vertical members to be fastened to an interior surface of the building.

38. The apparatus of claim 37, where the lower flange is configured to enable the first and second internal vertical members to be fastened to an interior floor of the building.

39. The apparatus of claim 37, where the lower flange has one or more holes for a fastener.

40. The apparatus of claim 36, further comprising a lower cross member coupling between the first and second internal vertical members below the first and second support locations.

41. The apparatus of claim 36, where the upper support structure is removably coupled to the first and second internal vertical members.

42. The apparatus of claim 36, where the first vertical sleeve has one or more holes that align with one or more holes in the first internal vertical member to enable the first vertical sleeve to be pinned to the first internal vertical member; and the second vertical sleeve has one or more holes that align with one or more holes in the second internal vertical member to enable the second vertical sleeve to be pinned to the second internal vertical member.

43. The apparatus of claim 36, where the first bracket further comprises a first diagonal support member coupling between the first sleeve and a first side of the working region of the platform; and the second bracket further comprises a second diagonal support member coupling between the second sleeve and a second side of the working region of the platform.

44. The apparatus of claim 36, further comprising a safety rail removably mounted to the perimeter of the working region of the platform.

45. The apparatus of claim 44, where the safety rail comprises:

a plurality of posts mountable in receptacles on the perimeter of the working region of the platform; and a plurality of low-stretch links coupled between posts of the plurality of posts.

46. The apparatus of claim 45, where a low-stretch link of the plurality of low-stretch links comprises a chain.

47. The apparatus of claim 45, where a low-stretch link of the plurality of low-stretch links comprises a cable.

48. The apparatus of claim 36, where the first and second internal vertical members are approximately seven feet in length.

49. The apparatus of claim 36, further comprising:

first and second wheels attached to the apparatus in proximity to the lower ends of the first and second internal vertical members, respectively.

50. The apparatus of claim 49, where the apparatus is supported by the first and second internal vertical members when the first and second internal members are oriented at, or close to, vertical and the apparatus is supported by the first and second wheels when the first and second internal members are oriented at, or close to, horizontal.

51. The apparatus of claim 36, where the first and second vertical sleeves of the upper support structure are adjustably located on the first and second internal vertical members.

52. The apparatus of claim 36, where support of the platform is provided exclusively by the first and second internal vertical members via the first and second brackets.

* * * * *